US007610778B2

(12) United States Patent
Oh et al.

(10) Patent No.: US 7,610,778 B2
(45) Date of Patent: Nov. 3, 2009

(54) WASHING MACHINE

(75) Inventors: Soo Young Oh, Seoul (KR); Kyung Chul Woo, Seoul (KR); Jin Woong Kim, Gyeonggi-Do (KR); Si Moon Jeon, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/699,970

(22) Filed: Jan. 31, 2007

(65) Prior Publication Data

US 2007/0125133 A1 Jun. 7, 2007

Related U.S. Application Data

(62) Division of application No. 10/757,990, filed on Jan. 16, 2004.

(30) Foreign Application Priority Data

Aug. 13, 2003 (KR) ..... 2003-56224

(51) Int. Cl.
*B08B 3/12* (2006.01)
*D06F 39/04* (2006.01)
*D06F 39/08* (2006.01)

(52) U.S. Cl. ..... 68/5 R; 68/12.01; 68/12.21; 68/13 R

(58) Field of Classification Search ..... 68/5 A–5 E, 68/7, 8, 12.01, 12.22, 5 R, 12.21, 13 R, 20
See application file for complete search history.

(56) References Cited

U.S. PATENT DOCUMENTS

| | | | | |
|---|---|---|---|---|
| 1,501,746 | A | 7/1924 | Carter | |
| 1,852,179 | A | 4/1932 | McDonald | |
| 1,999,446 | A * | 4/1935 | Delano | 219/630 |
| 2,431,246 | A | 11/1947 | Hallanan | |
| 2,574,098 | A | 11/1951 | Fraraccio | |
| 2,584,833 | A * | 2/1952 | Beucler | 68/18 F |
| 2,664,094 | A | 12/1953 | Spragins | |
| 2,695,103 | A * | 11/1954 | Armstrong | 34/318 |
| 3,129,361 | A * | 4/1964 | Berenbaum | 361/166 |
| 3,615,822 | A | 10/1971 | Molinari | |
| 4,471,792 | A | 9/1984 | Koblenzer | |
| 4,941,333 | A * | 7/1990 | Blessing | 68/19.2 |
| 5,180,438 | A | 1/1993 | Hockh et al. | |
| 5,461,887 | A * | 10/1995 | VonPless | 68/18 F |
| 5,962,288 | A * | 10/1999 | Aksenov et al. | 435/173.1 |
| 6,161,306 | A | 12/2000 | Clodic | |

(Continued)

FOREIGN PATENT DOCUMENTS

DE 34 08 136 A1 9/1985

(Continued)

*Primary Examiner*—Michael Barr
*Assistant Examiner*—Rita R Patel
(74) *Attorney, Agent, or Firm*—Birch, Stewart, Kolasch & Birch, LLP

(57) ABSTRACT

A washing machine includes a tub disposed inside a cabinet, for storing water; a drum rotatably disposed inside the tub, for washing laundry; and a steam generating apparatus disposed at the cabinet, for generating steam supplied to the inside of the drum, by using high-frequency induction heating. Accordingly, by generating steam using high-frequency induction heating, a structure of the steam generating apparatus can be simplified, and performance of generating steam can be improved.

27 Claims, 3 Drawing Sheets

U.S. PATENT DOCUMENTS

| | | | | |
|---|---|---|---|---|
| 6,299,076 | B1 * | 10/2001 | Sloan et al. | 239/136 |
| 6,434,857 | B1 * | 8/2002 | Anderson et al. | 34/595 |
| 6,585,781 | B1 * | 7/2003 | Roseen | 8/149.1 |
| 6,811,811 | B2 | 11/2004 | Gerald France et al. | |
| 6,854,300 | B2 | 2/2005 | Monteiro et al. | |
| 2002/0117497 | A1 * | 8/2002 | Bassill et al. | 219/626 |
| 2004/0187529 | A1 * | 9/2004 | Kim et al. | 68/207 |
| 2005/0092035 | A1 | 5/2005 | Shin et al. | |

FOREIGN PATENT DOCUMENTS

| | | | | |
|---|---|---|---|---|
| DE | 19743508 | A1 | * | 4/1999 |
| DK | 19743508 | A1 | | 4/1999 |
| EP | 0 302 125 | A1 | | 2/1989 |
| EP | 0816550 | A1 | | 1/1998 |
| EP | 1 275 767 | A1 | | 1/2003 |
| EP | 1 469 120 | A1 | | 10/2004 |
| EP | 1 507 028 | A1 | | 2/2005 |
| GB | 21286 | | | 8/1898 |
| JP | 61-128995 | A | | 6/1986 |
| JP | 05-023493 | A | | 2/1993 |
| JP | 11-226290 | | | 8/1999 |
| JP | 2000176192 | A | * | 6/2000 |
| JP | 2002106801 | | | 1/2002 |
| JP | 2002083673 | | | 3/2002 |
| JP | 2002106801 | A | * | 4/2002 |
| JP | 2002-181306 | A | | 6/2002 |
| JP | 2003-019382 | | * | 1/2003 |
| JP | 2003-019382 | A | | 1/2003 |
| JP | 2003021303 | | | 1/2003 |
| JP | 2003021303 | A | * | 1/2003 |
| JP | 2003-093775 | | | 4/2003 |

* cited by examiner

WASHING MACHINE

This application is a Divisional of co-pending application Ser. No. 10/757,990 filed on Jan. 16, 2004, and for which priority is claimed under 35 U.S.C. §120; and this application claims priority of Application No. 5622412003 filed in Korea on Aug. 13, 2003 under 35 U.S.C. § 119; the entire contents of which are hereby incorporated by reference

BACKGROUND OF THE INVENTION

1. Field of the Invention

The present invention relates to a washing machine, and more particularly, to a washing machine capable of heating laundry by spraying steam thereon.

2. Description of the Background Art

FIG. 1 is a sectional view of a drum washing machine according to the conventional art.

The conventional washing machine includes a cabinet 102 forming the exterior, a tub 104 positioned inside the cabinet 102 and storing water, a drum 106 rotatably disposed inside the tub 104 and performing washing and dewatering operation of the laundry, and a driving motor 110 connected to the drum 106 by a driving shaft 108 and rotating the drum 106. The tub 104 is buff-supported by dampers 120 and 122 inside the cabinet 102, and a heater 130 for heating water stored in the tub 104 is installed at a lower side of the tub 104.

Herein, a sufficient space is to be secured for installing the heater 130 between the tub 104 and the drum 106, and the water level inside the tub 104 needs to be maintained by more than a predetermined amount so that the heater 130 can be sufficiently soaked in water.

The operation of the conventional drum washing machine will now be described.

When the washing machine is driven, water is supplied into the tub 104, and when the water level in the tub 104 reaches a pre-set level, the heater 130 is operated to heat water. And the driving motor 110 is moved forwardly and backwardly at the same time when the water is heated by the heater 130, thereby performing a washing operation. When the temperature of water reaches a pre-set temperature, the heater 130 is turn off.

However, the conventional washing machine has a problem that since a receiving space should be obtained at the lower side of the tub 104 in order to install the heater 130 therein for heating the laundry, the overall size of the washing machine is increased, and in addition, since water is filled in the heater-received space, water is much wasted. In addition, since water is heated by the heater 130, a power consumption of the heater 130 is increased, use amount of detergent is increased, and washing time is lengthened.

SUMMARY OF THE INVENTION

Therefore, one object of the present invention is to provide a washing machine capable of reducing an overall size and the amount of water used for washing, minimizing power consumption, and shortening a washing time by heating the laundry by spraying stream directly to the laundry.

Another object of the present invention is to provide a washing machine capable of simplifying a structure of the steam generating apparatus and improving performance of generating steam by generating steam using high-frequency induction heating.

To achieve these and other advantages and in accordance with the purpose of the present invention, as embodied and broadly described herein, there is provided a washing machine including A washing machine comprising: a tub disposed inside a cabinet, for storing water; a drum rotatably disposed inside the tub, for washing laundry; and a steam generating apparatus disposed at the cabinet, for generating steam supplied to the inside of the drum, by using high-frequency induction heating.

The steam generating apparatus includes a housing having a water supply pipe through which water is supplied, and a steam discharge pipe through which steam is discharged; a coil disposed at an outer circumferential surface of the housing, for generating a high-frequency magnetic field; and a heating material disposed inside the housing to generate heat, for generating steam supplied into the housing , by the high-frequency magnetic field generated from the coil.

The steam discharge pipe of the housing is connected with a spray nozzle by a steam supply line so that the steam generated from the housing is sprayed into the drum through the spray nozzle.

A fan is installed at one side of the steam supply line, for increasing spray pressure of the spray nozzle.

The coil is wound on the outer circumferential surface of the housing, and is electrically connected with an inverter applied a high-frequency current.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
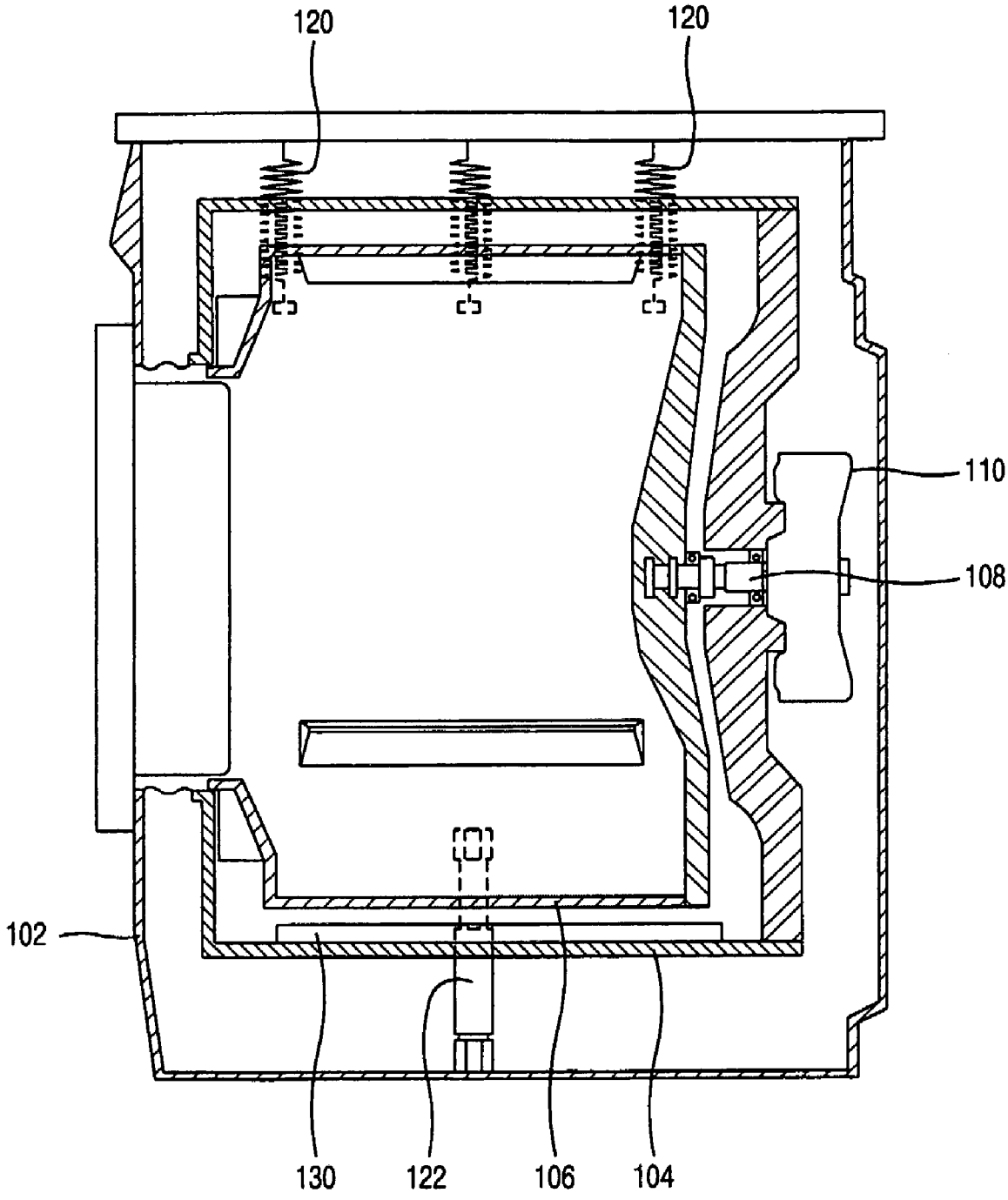
FIG. 1 CONVENTIONAL ART
FIG. 1 is a sectional view of a drum washing machine according to the conventional art.
Figure 2:
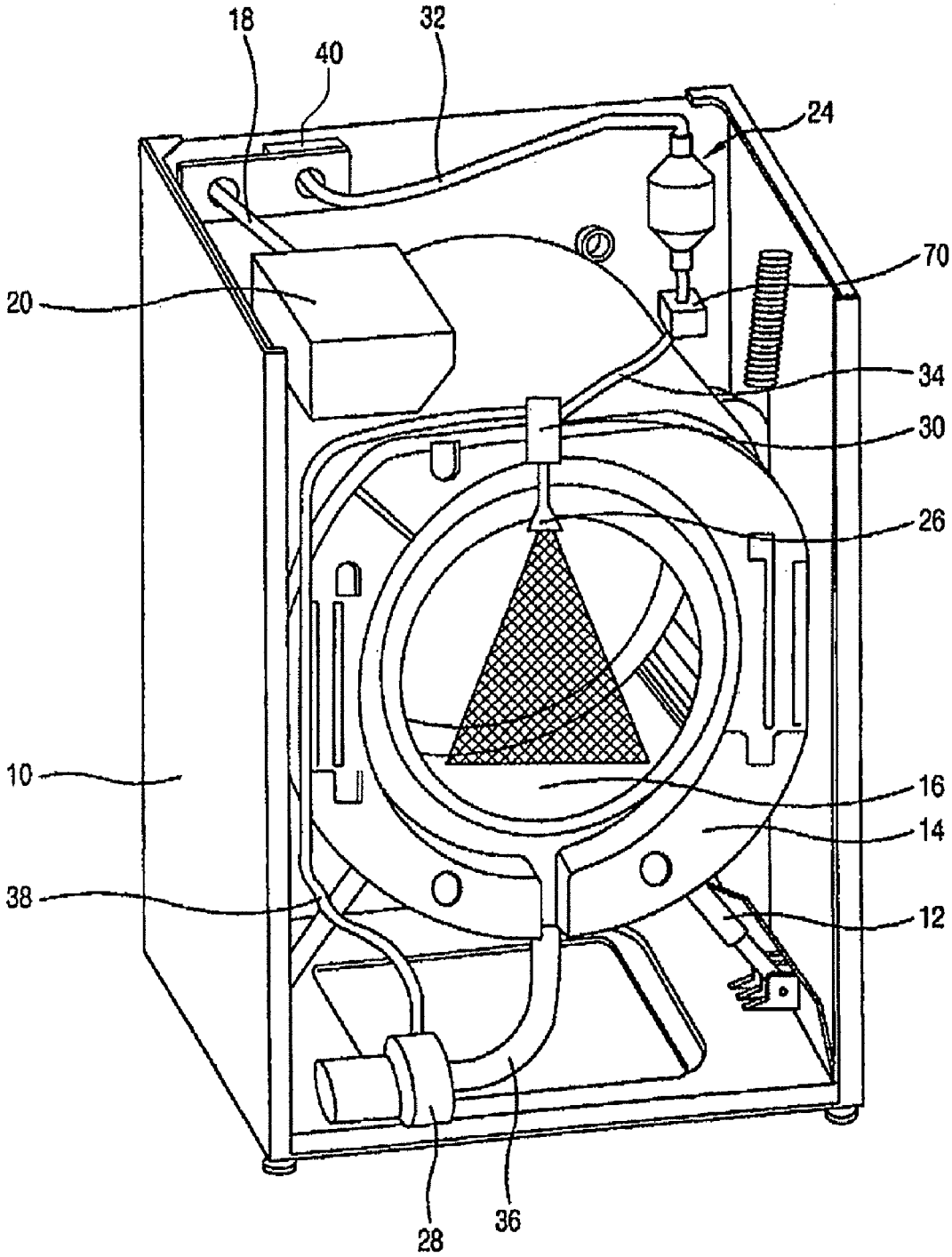
FIG. 2 is a perspective view showing a washing machine of which a front surface is opened according to the present invention.

FIG. 2 is a perspective view of a washing machine of which a front surface is opened according to one embodiment of the present invention.

A washing machine according to one embodiment of the present invention includes a cabinet 10 forming an exterior; a tub 14 shock-absorbingly supported by a damper at the cabinet 10, for storing washing water; a drum 16 rotatably disposed inside the tub 14, for washing and dewatering laundry; a steam generating apparatus 24 disposed at an upper portion of the cabinet 10, for generating steam; a circulation pump 28 disposed at the lower portion of the tub 14, and for pumping water discharged from the tub 14 to resupply the water into the tub 14; and a spray nozzle 26 for spraying one of steam generated at the steam generating apparatus 24 and water circulated by the circulation pump 28 into the drum 16.

A detergent box 20 connected to a water supply tube 18 is installed at an upper side of the outer tub 14 thus to supply detergent with washing water into the outer tub 14.

And, a dividing unit 30 is installed at the spray nozzle 26, for preventing flowing backward steam generated by the steam generating apparatus 24 and water pumped by pumping of the circulation pump 28.

The steam generating apparatus 24 is connected with the water supply line 32 to receive water from the outside, and is connected with the dividing unit 30 by a steam supply line 34. Herein, at one side of the water supply line 32, a water supply valve 40 for opening/closing the water supply line 32 is installed to supply water to the steam generating apparatus 24 or to cut off the water supply.

The circulation pump 28 is connected with a discharge pipe 36 through which water stored in the tub 14 is discharged, and is connected with the dividing unit 30 by a circulation line 38. Thus, the circulation pump 28 pumps water discharged from the discharge pipe 36 and supplies the water to the dividing unit 30 through the circulation line 38. And, the water supplied to the dividing unit 30 is sprayed into the drum 16 through the spray nozzle 26.

Figure 3:
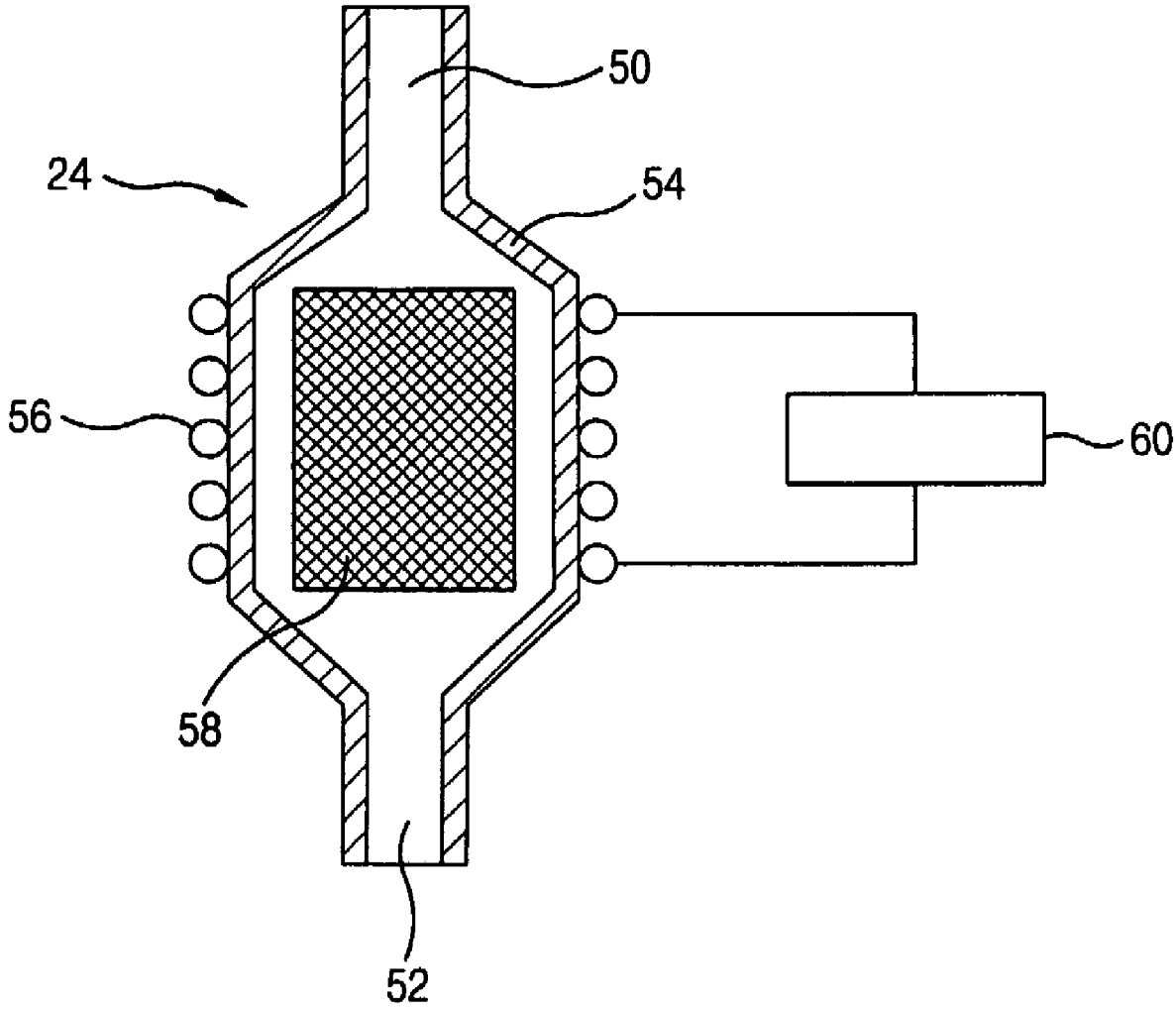
FIG. 3 is a sectional view showing a steam generating apparatus according to the present invention.

FIG. 3 is a sectional view of a steam generating apparatus according to the present invention.

The steam generating apparatus 24 includes a housing 54 having a water supply pipe 50 connected with the water supply line 32, and through which water is supplied, and a steam discharge pipe 52 connected with a steam supply line 34, and through which steam is discharged; a coil 56 disposed at an outer circumferential surface of the housing 54, and through which a high-frequency current flows so that a high-frequency magnetic field is generated; and a heating material 58 disposed at the inside of the housing 54, and which generates heat by the high-frequency magnetic field generated at the coil 56, and thus, heats water supplied into the housing 54 thereby generating steam.

In order to increase pressure of steam discharged at the spray nozzle 26, a fan 70 for sending air to steam is installed at the steam supply line 34 connected with the steam discharge pipe 52 of the housing 54, The coil 56 is wound on an outer circumferential surface of the housing 54 in a longitudinal direction of the housing, and is electrically connected with an inverter 60 applying a high-frequency current.

The steam generating apparatus 24 constructed as above performs heating by the same principle as that of a high-frequency induction heating apparatus which is generally used.

Operations of the washing machine according to the present invention constructed as above will now be described.

First, after putting laundry into the drum 16, when a user presses a steam wash operating button, water flowed to the water supply line 18 passes through the detergent box 20 and is supplied to the inside of the tub 14 together with a detergent. And, the washing machine performs an operation of dissolving the detergent for a certain time. Then, the water supply valve 40 operated, and so the water supply line 32 is opened so that water is supplied into the housing 54 through the water supply pipe 50.

At this time, when power is applied to the inverter 60, the high-frequency current is applied to the coil 56 and thus a high-frequency magnetic field is generated at the coil 56, so that the heating material 58 disposed at the inside of the housing 54 generates heat by an electromagnetic induction. Then, passing through the heating material 58, the water supplied into the housing through the water supply pipe 50 momentarily steams. The steam is discharged to the steam discharge pipe 52 and supplied to the spray nozzle through the dividing unit 30. Then, through the spray nozzle 26, the steam is directly sprayed on laundry stored at the inside of the drum 16.

Then, when the temperature in the tub 14 reaches a certain temperature, the water supply valve 40 is closed thereby preventing water from being supplied to the housing 54, and at the same time, preventing the current from being supplied to the coil 56, so that the operation of the steam generating apparatus 24 is stopped.

In the washing machine according to the present invention constructed and operated as above, steam is sprayed into the drum of the washing machine to heat the laundry, thereby reducing an entire size of the washing machine, reducing the amount of water used for washing, minimizing power consumption, and shortening time for washing.

In addition, the washing machine according to the present invention is provided with a steam generating apparatus using a high-frequency induction heating principle, thereby simplifying a structure of the steam generating apparatus and improving performance of generating steam.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A laundry machine comprising:

a drum configured to rotate about a horizontal axis;

a tub located outside the drum;

a steam generating apparatus configured to generate steam by heating water, the steam generating apparatus including:

a tubular member; and a heating system, at least a portion of the heating system being located outside the tubular member;

a steam supply line configured to provide a passage to the steam generated by the steam generating apparatus such that the steam can be supplied inside the drum of the laundry machine;

a water supply line configured to provide a passage to the water to be supplied to the steam generating apparatus;

a water supply valve configured to open/close the water supply line; and a water supply tube configured to supply washing water into the tub separately from the water supply line.

2. The laundry machine of claim 1, wherein the steam generator includes a housing having a water inlet and a steam outlet, the water inlet being in communication with the water supply line, and the steam outlet being in communication with the steam supply line, wherein the heating system includes a heating material located inside of the housing to generate heat, and wherein water supplied into the housing passes through the heating material and becomes steam while flowing from the water inlet through the housing toward the steam outlet.

3. The laundry machine of claim 2, wherein the housing includes a water supply pipe in flow communication with the water supply line and a steam discharge pipe in flow communication with the steam supply line.

4. The laundry machine of claim 3, wherein a part of the housing between the water supply pipe and the steam discharge pipe has a bigger cross-section than a cross-section of at least one of the water supply pipe and the steam discharge pipe.

5. The laundry machine of claim 2, wherein the water supply valve is closed when the temperature in the tub reaches a certain temperature, thereby preventing water from being supplied to the steam generating apparatus.

6. The laundry machine of claim 2, wherein the operation of the steam generating apparatus is stopped when the temperature in the tub reaches a certain temperature.

7. The laundry machine of claim 2, further comprising:

a discharge pipe configured to discharge water stored in the tub;

a circulation pump configured to pump the discharged water; and a circulation line configured to supply the discharged water into the drum.

8. The laundry machine of claim 7, further comprising:

a dividing unit connected with the circulation line and the steam supply line, respectively; and a spray nozzle configured to spray the discharged water and the steam directly into the drum.

9. The laundry machine of claim 2, further comprising a steam wash operating button.

10. The laundry machine of claim 2, wherein the drum has a substantially cylindrical sidewall with opposing ends, one of the opposing ends having an opening adapted so that clothes are put in the drum through the opening.

11. The laundry machine of claim 1, wherein the heating system includes a coil located around the outer circumference of the tubular member.

12. The laundry machine of claim 1, wherein the heating system includes a heating material located inside of the tubular member to generate heat.

13. The laundry machine of claim 1, wherein a part of the tubular member between the water supply line and the steam supply line has a bigger cross-section than a cross-section of at least one of the water supply line and the steam supply line.

14. The laundry machine of claim 1, wherein:

the tubular member has a water inlet and a steam outlet, the heating system is configured to convert water flowed to the steam generator to steam as the water progresses through the tubular member from the water inlet to the steam outlet.

15. The laundry machine of claim 14, wherein a part of the tubular member between the water supply line and the steam supply line has a bigger cross-section than a cross-section of at least one of the water supply line and the steam supply line

16. The laundry machine of claim 14, wherein the drum has a substantially cylindrical sidewall with opposing ends, one of the opposing ends having an opening adapted so that clothes are put in the drum through the opening.

17. The laundry machine of claim 14, further comprising a steam wash operating button.

18. The laundry machine of claim 1, wherein the water supply valve is closed when the temperature in the tub reaches a certain temperature, thereby preventing water from being supplied to the steam generating apparatus.

19. The laundry machine of claim 1, wherein the operation of the steam generating apparatus is stopped when the temperature in the tub reaches a certain temperature.

20. The laundry machine of claim 1, further comprising:

a discharge pipe configured to discharge water stored in the tub;

a circulation pump configured to pump the discharged water; and a circulation line configured to supply the discharged water into the drum.

21. The laundry machine of claim 20, further comprising:

a dividing unit connected with the circulation line and the steam supply line, respectively; and a spray nozzle configured to the spray the discharged water and the steam into the drum.

22. The laundry machine of claim 1, further comprising a steam wash operating button.

23. The laundry machine of claim 1, wherein the drum has a substantially cylindrical sidewall with opposing ends, one of the opposing ends having an opening adapted so that clothes are put in the drum through the opening.

24. A laundry machine comprising:

a drum configured to rotate about a horizontal axis;

a steam generating apparatus configured to generate steam by heating water, the steam generating apparatus including:

a tubular member; and a heating system, at least a portion of the heating system being located outside the tubular member, the heating system including a coil located around the outer circumference of the tubular member so as not to contact the water used to generate steam; and a steam supply line configured to provide a passage to the steam generated by the steam generating apparatus such that the steam can be supplied inside the drum of the laundry machine.

25. The laundry machine of claim 24, wherein the drum has a substantially cylindrical sidewall with opposing ends, one of the opposing ends having an opening adapted so that clothes are put in the drum through the opening.

26. The laundry machine of claim 24, wherein:

the tubular member has a water inlet and a steam outlet, and the heating system is configured to convert water flowed to the steam generator to steam as the water progresses through the tubular member from the water inlet to the steam outlet.

27. The laundry machine of claim 24, further comprising a steam wash operating button.

* * * * *